US008362346B1

(12) United States Patent
Prozinski

(10) Patent No.: US 8,362,346 B1
(45) Date of Patent: Jan. 29, 2013

(54) HARMONICA HOLDER AND SOUND BAFFLE

(75) Inventor: Dan Edward Prozinski, Minneapolis, MN (US)

(73) Assignee: Dan Edward Prozinski, Minneapolis, MN (US)

( * ) Notice: Subject to any disclaimer, the term of this patent is extended or adjusted under 35 U.S.C. 154(b) by 0 days.

(21) Appl. No.: 13/189,728

(22) Filed: Jul. 25, 2011

(51) Int. Cl.
*G10D 7/12* (2006.01)

(52) U.S. Cl. ..... 84/379

(58) Field of Classification Search ..... 84/379
See application file for complete search history.

(56) References Cited

U.S. PATENT DOCUMENTS

| | | | | |
|---|---|---|---|---|
| 411,374 | A | 9/1889 | Clark | |
| 923,689 | A * | 6/1909 | Newsam | 84/378 |
| 1,912,654 | A * | 6/1933 | Clarence | 84/379 |
| 1,951,928 | A * | 3/1934 | Elkington | 84/378 |
| D166,437 | S * | 4/1952 | Zielinski | D17/13 |
| 2,945,408 | A * | 7/1960 | Terlinde | 84/743 |
| 3,332,310 | A * | 7/1967 | Pochobradsky | 84/379 |
| 4,212,219 | A * | 7/1980 | Hubbard | 84/723 |
| 4,287,803 | A * | 9/1981 | Zema | 84/723 |
| 4,397,213 | A * | 8/1983 | Hubbard | 84/453 |
| 4,414,879 | A * | 11/1983 | Ruiz | 84/379 |
| 4,541,321 | A * | 9/1985 | Miner, Jr. | 84/379 |
| 5,479,841 | A * | 1/1996 | Garrett | 84/379 |
| 7,091,408 | B2 * | 8/2006 | Thibodeau | 84/377 |
| 7,381,875 | B2 * | 6/2008 | Berschneider | 84/379 |
| 7,638,698 | B1 * | 12/2009 | Bellissimo | 84/379 |

* cited by examiner

*Primary Examiner* — David Warren
*Assistant Examiner* — Robert W Horn

(57) ABSTRACT

An adjustable, adaptable, hands-free harmonica holder for suspending a harmonica from an existing stand, providing a new method for a performer to play the harmonica while simultaneously playing other instruments. The holder comprising an attachment mechanism for securing the subject apparatus to a stand, adjustable arm or arms extending from said attachment mechanism to support the harmonica, a platform to which the harmonica is mounted, and a sound baffle, said sound baffle being adaptable to both deflect and isolate voice and harmonica sounds.

9 Claims, 4 Drawing Sheets

HARMONICA HOLDER AND SOUND BAFFLE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND AND PRIOR ART

Some musicians play the harmonica simultaneously with other instruments like guitar, piano, accordion, drums, etc. This can be done with a hands-free harmonica holder and the most prevalent harmonica holder is of the harness, or "neck-brace" design, commonly made of wire and designed with a clamping mechanism to hold the harmonica. When used by a performer on stage with amplified instruments and sound systems this neck-brace holder presents certain problems in that: (1) The harmonica is in constant motion in relation to the microphone thereby presenting an inconsistent sound level and tone. (2) A brace can be awkward to wear and the performer's movement near the microphone is hindered by the bulk of the brace itself. (3) A neck-brace holder requires an aggressive damping device to insure the harmonica is held firmly while the performer moves about. These damps make it difficult to change harmonicas quickly and easily. (4) These problems on the stage can also create problems for the audio engineer responsible for adjusting the volume and tone levels of all the other various band instruments on stage. With a performer utilizing a neck-brace harmonica holder, the audio engineer may need to make quick adjustments between the sound of the performer's singing voice and that of the performer's harmonica playing.

A less common harmonica holder but one with great potential is of the harmonica stand variety. Attempts at this approach have to date produced physically and visually awkward holders that are impractical in use. Some previous harmonica stands involve an entire stand built to hold a harmonica with a large dedicated microphone for the harmonica as well as a duplicate large vocal microphone for the performer to sing into. Other designs feature lame bulky shrouds or horns intended to envelop the harmonica and confine the sound, again to a secondary large dedicated microphone. These stands and holders require the performer to move significantly back and forth in position between the harmonica and the vocal microphone.

SUMMARY

One embodiment of my holder is directed to a harmonica holder designed to be quickly attached to an existing microphone stand, allowing the performer to utilise a single existing vocal microphone to amplify both vocal and harmonica sounds. This provides a new method for a performer to sing, play the harmonica, and simultaneously play other instruments at the same time, by holding the harmonica in a set position in proximity to the performers vocal microphone.

In a preferred embodiment of the holder I provide for; attaching the holder to an existing stand; mounting the harmonica to the holder; adjustment of and distance of the harmonica relative to a microphone; isolating and directing the harmonica sound towards a microphone via a sound baffle.

In a preferred embodiment the holder includes an adaptable sound baffle that acts to either reflect harmonica sound towards the performers existing vocal microphone, or optionally isolate and direct harmonica sounds to a small secondary microphone dedicated to the harmonica.

According to one embodiment, the sound baffle provides the platform to which the harmonica is mounted to the holder.

According to one embodiment, the holder includes a support arm or arms that hold the harmonica in a set position in proximity to the vocal microphone.

According to one embodiment, the holder allows for refined and consistent amplification of an attached harmonica by maintaining the harmonica in a set position relative to a microphone.

DETAILED DESCRIPTION OF THE PREFERRED EMBODIMENTS

Figure 1:
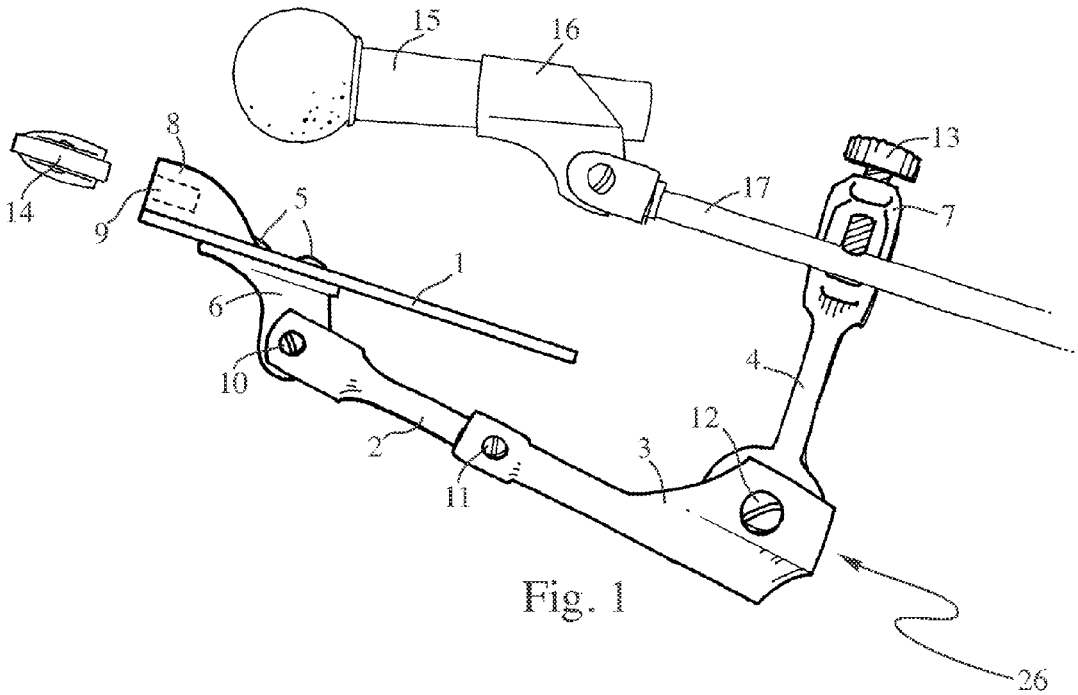
FIG. 1 is a side view of the harmonica holder according to one embodiment, shown damped to the lateral arm of a microphone stand with the sound baffle arranged for use with a single microphone.

Referring to the drawings. FIG. 1 illustrates an embodiment of the harmonica holder 26 that utilizes the performers existing vocal microphone 15, and existing microphone clip 16, to also amplify the sound of a harmonica 14 when mounted to the holder. The holder is shown clamped to the lateral arm extension 17 of a microphone stand and the harmonica is shown positioned in line for insertion into the holder. In this embodiment the holder is attached to the microphone stand by utilizing the knob screw 13 of clamp 7, and the harmonica 14 is mounted to the holder by sliding the outside edges of the harmonica into channels 9 of braces 8. In this embodiment, adjusting the position of the harmonica 14 relative to the vocal microphone 15 can be accomplished by adjusting the angle of the holder boom arms 4 and 3 at locking pivot screw 12 and then tightening said screw 12. In this embodiment, further refining the placement of the harmonica can be done by sliding the telescoping portion of the holder boom arm 2 in and out of holder boom arm 3, then tightening the boom arm set screw 11. Locking screw 10 is used to adjust the angle of the support bracket 6 and sound baffle 1. The angle of the microphone 15 is adjusted by its clip 16. In this embodiment, the sound baffle also acts as a platform to which the harmonica is mounted and the sound baffle aids in the amplification of harmonica sounds by reflecting harmonica sounds up into the vocal microphone 15. In this embodiment, control of the harmonica volume and tone is aided by the performer's ability to adjust the angle and proximity of the holder and sound baffle 1 relative to the vocal microphone.

Figure 2:
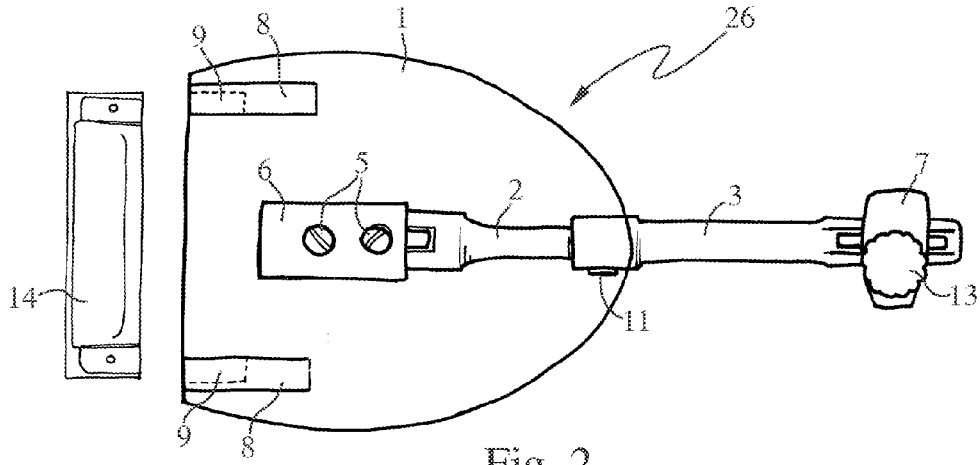
FIG. 2 is a top view of the harmonica holder according to one embodiment, with the harmonica shown positioned in line for insertion into the holder.

As shown in the holder 26 top view of FIG. 2, a potential material choice for the construction of the sound baffle 1 might be a clear plastic as this would help to minimize visual clutter in front of the performer. The harmonica is shown in line for insertion into the channels 9 of braces 8.

Figure 3:
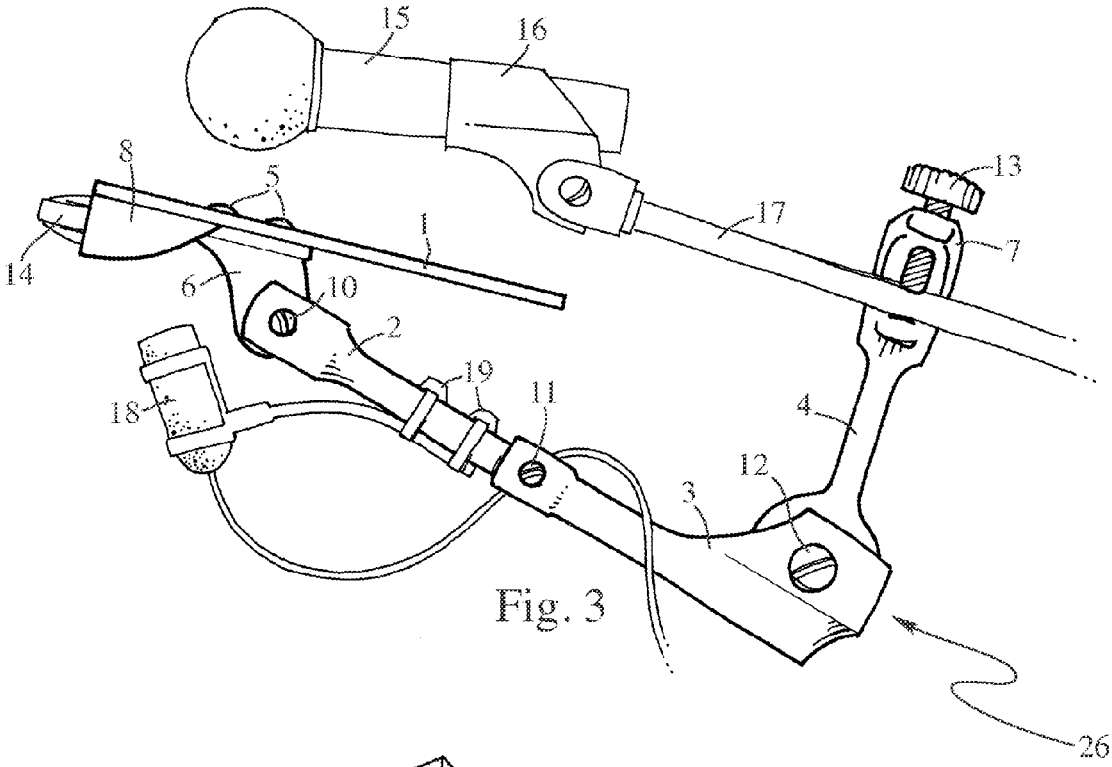
FIG. 3 is a side view of the harmonica holder according to one embodiment, shown damped to the lateral arm of a microphone stand with the sound baffle flipped and an optional small instrument microphone added. The harmonica is shown mounted in the holder.

FIG. 3 illustrates a modified embodiment of the holder 26 showing the multi-functional design of the sound baffle when utilized with a small microphone 18 dedicated to the harmonica. By employing screws 5, the sound baffle 1 can be flipped to hold the harmonica 14 beneath said sound baffle 1. The harmonica in this position is now isolated from the vocal microphone 15 by the sound baffle and the harmonica sounds are picked-up by this secondary microphone 18. This embodiment shows a commercially available cardioid condenser instrument microphone 18 strapped to the holder arm 2 with zip-ties 19. The harmonica is shown fully mounted in the channels 9 of braces 8.

Figure 4:
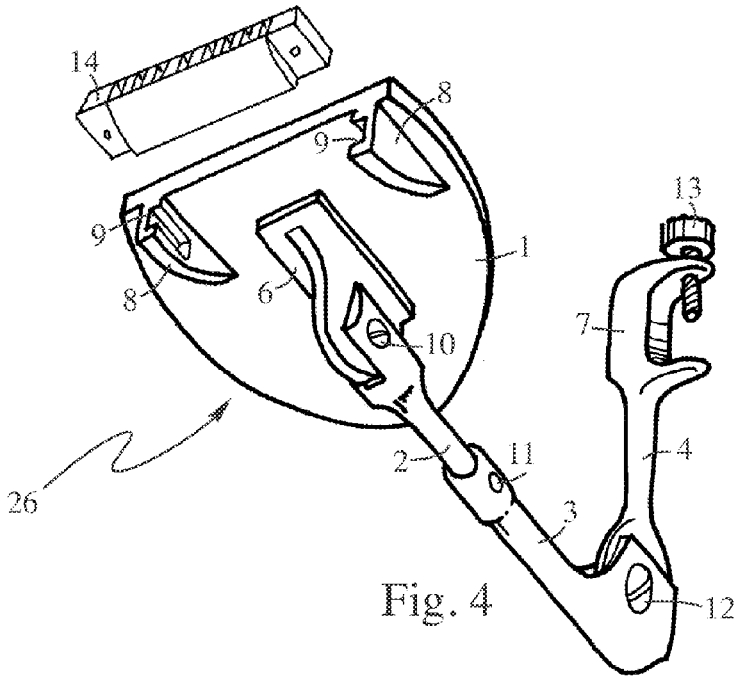
FIG. 4 is a perspective view according to one embodiment, with the harmonica shown positioned in line for insertion into the holder.

FIG. 4 shows a perspective view of the holder 26 according to one embodiment, shown from below the harmonica holder. The harmonica is shown in line for insertion into the channels 9 of braces 8.

Figure 5:
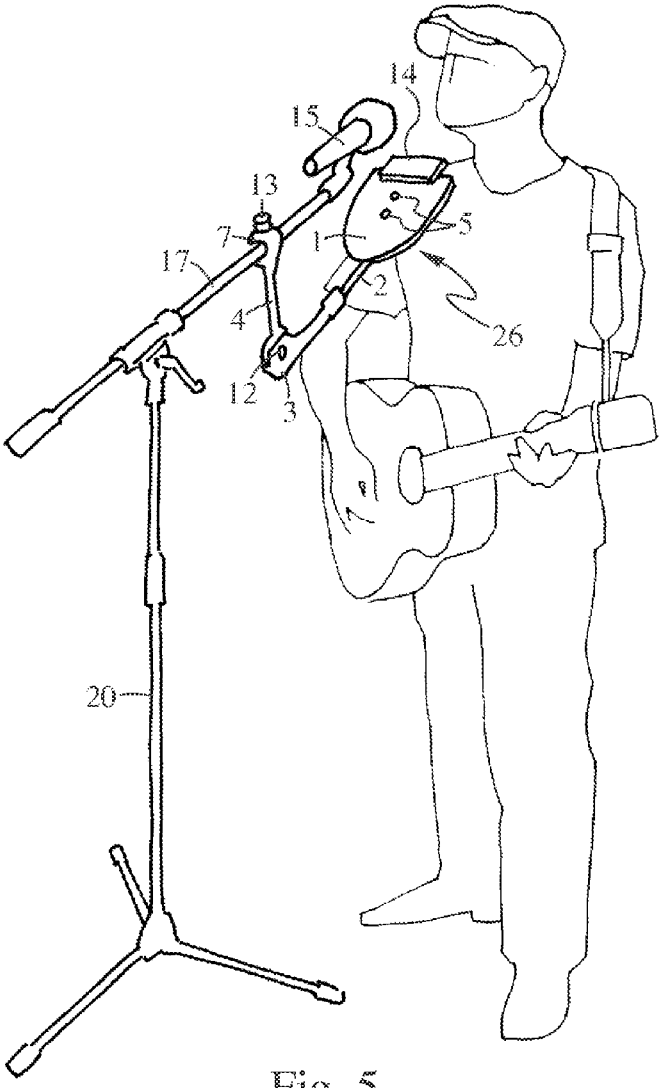
FIG. 5 is a perspective view of the harmonica holder according to one embodiment, damped to the lateral arm of a microphone stand. A musical performer is depicted standing in a playing position.

FIG. 5 illustrates one embodiment of the holder 26 in use with an existing microphone and stand. The holder is shown attached to the lateral arm extension 17 of a music stand 20 with the performer shown standing in position in front of the microphone 15. The harmonica 14 is held by the holder in proximity to the microphone allowing the performer to alternate between voice and harmonica playing with very little head movement.

Figure 6:
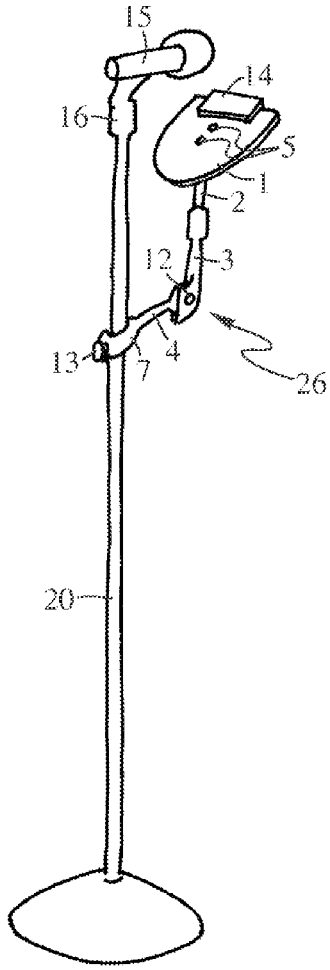
FIG. 6 is a perspective view of the harmonica holder according to one embodiment, clamped to the vertical riser of a microphone stand.
Figure 7:
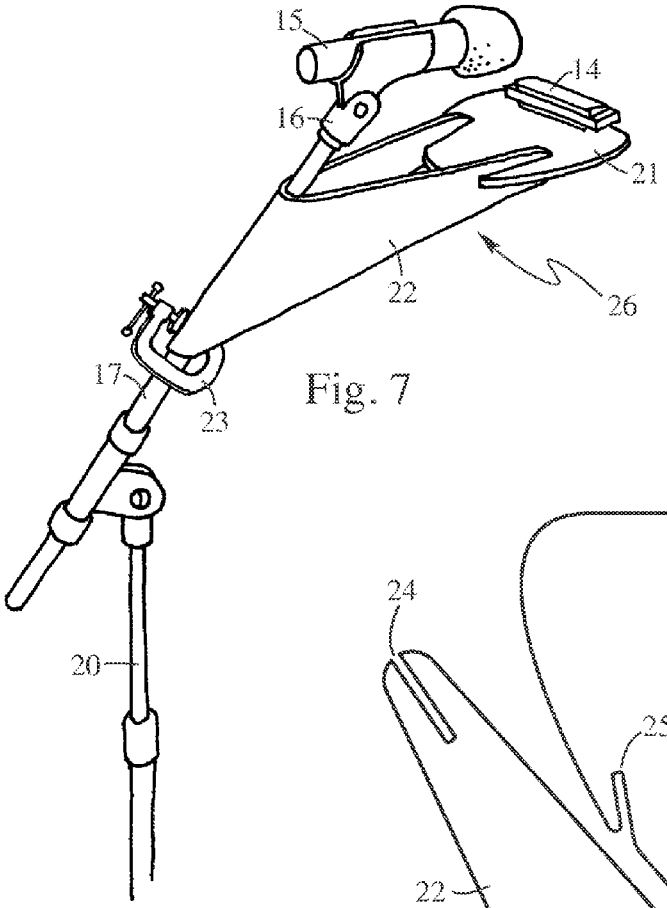
FIG. 7 is an alternative embodiment of the holder in use with a single microphone positioned for amplification of both human voice and harmonica playing. The harmonica is shown mounted to the sound baffle.
Figure 8:
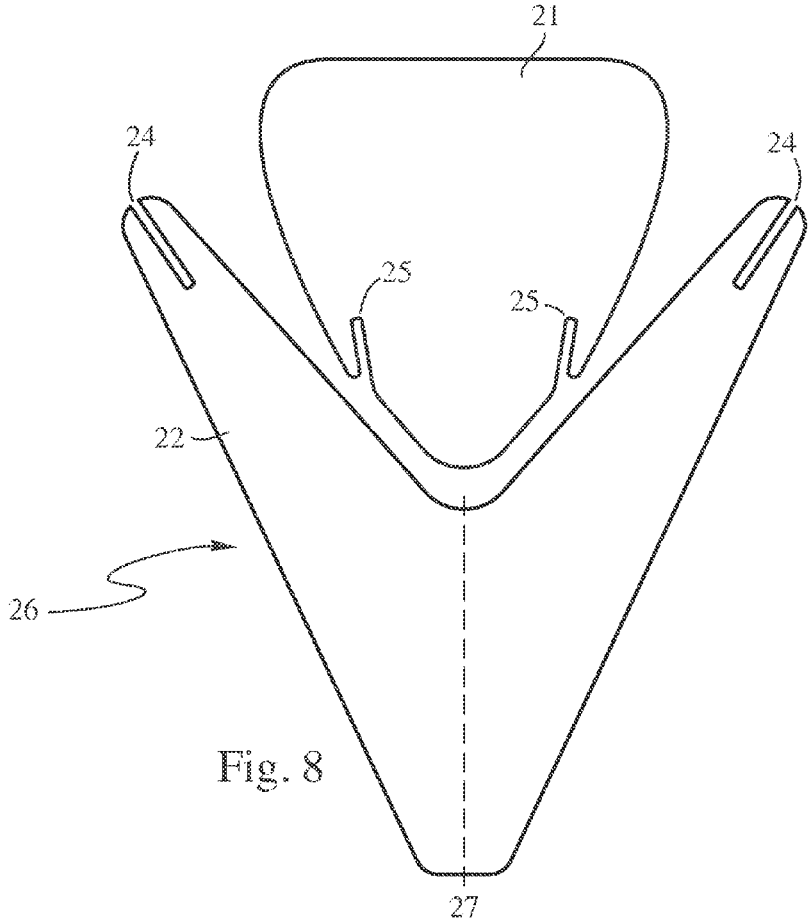
FIG. 8 outlines the unformed and unassembled parts of the alternative embodiment shown previously in FIG. 7. This illustration could be used as a dieline in cutting or stamping these two holder parts.

FIG. 6 illustrates an embodiment of the holder 26 adjusted for attachment to the vertical riser 20 of a simpler microphone and stand arrangement.

in an embodiment of the holder 26 shown in FIG. 7 it is demonstrated that the method and objectives of the holder can also be achieved with a simplified design utilizing shaped and formed sheet material fitted together with slots. With this embodiment the method for playing the harmonica remains the same, though the ability to make adjustments in the position of the harmonica relative to the microphone is reduced. The benefit of this simplified embodiment is that it allows for economical manufacturing, in creating the embodiment of FIG. 7 two shapes are made from a rigid sheet material as illustrated in the dieline in FIG. 8. Shape 22 is bent in the middle along center line 27 such that it will conform around the music stand 17, the protrusions of shape 22 thus forming the boom arms of the holder as shown in FIG. 7. When the holder is attached to the stand the boom arms extend out and away from the stand. Said boom arms are slotted at the ends 24 to accept the sound baffle 21, which is slotted 25 to accept the slots of the boom arms in return. When the two pieces 21 and 22 are fitted together a more rigid structure is formed and the sound baffle 21 also acts as a platform to which the harmonica is mounted, in this embodiment a hook-and-loop product such as Velcro would provide a suitable mounting system for the harmonica. The performer would affix adhesive backed velcro to both the sound baffle and to one or more harmonicas. The harmonicas could then be changed easily during a performance. While FIG. 7, illustrates a holder embodiment attached to the stand utilizing a C-clamp 23, other embodiments may use other attachment mechanisms.

Although the holder has been described in connection with example embodiments, it should be understood that various modifications, additions and alterations may be made to the holder by one skilled in the art without departing from the spirit and scope of the holder as defined in the claims. As a further example, the simplified embodiment of FIG. 7 could be accomplished in whole or in part with other materials such as wire instead of rigid sheet material.

It can he seen from this detailed description that the holder meets its objectives in the following ways;

One embodiment of the holder provides a compact and portable harmonica holder that can be attached to a variety of stands. A great advantage to this is that a performer does not have to transport a full stand and may easily utilize any common stand typically provided by a music venue, church, theater, nightclub, etc.

One embodiment of the holder provides a multi-functional sound baffle that can be adapted to either hold the harmonica above or below said sound baffle. In this way the sound baffle acts to direct and isolate the sounds of a performers harmonica and voice as desired by the user.

One embodiment of the holder allows a performer to effectively utilize a single microphone for voice and harmonica (FIG. 1), or alternatively utilize a small, secondary microphone dedicated to the harmonica (FIG. 3).

One embodiment of the holder allows the harmonica to be held in a set position in proximity to the vocal microphone so that the performer can, with very little head movement, alternate quickly between singing and playing the harmonica (FIG. 5).

The holder allows for quick and efficient exchange of harmonicas.

The holder succeeds at all of the above-listed objects in such a way that is simple in design and use.

I claim:

1. A harmonica holder and method for suspending a harmonica on an existing stand, the harmonica holder comprising:

an attachment mechanism configured to be attached to an existing stand;

a first pivot connected to the attachment mechanism;

a telescoping boom arm with set screw, connected to the first pivot with a locking screw;

a second pivot connected to the telescoping boom arm;

a support bracket connected to the second pivot with a locking screw;

a platform held by screws to the support bracket, the platform providing a surface to which the harmonica is mounted, wherein the platform includes protruding braces that are channeled to accept and hold the outside edges of a harmonica; and a sound baffle shaped to direct and isolate harmonica and vocal sounds.

2. Apparatus according to claim 1 including; a mounting platform, wherein the mounting platform and the sound baffle are provided by the same piece of material.

3. Apparatus according to claim 1 including: a soundbaffle providing a surface shaped to direct and isolate harmonica and vocal sounds.

4. Apparatus according to claim 1 including: an adaptable sound baffle that can be flipped to either hold the harmonica above or below said sound baffle.

5. A harmonica holder for suspending a harmonica on an existing stand, the holder comprising of:

material shaped and bent such that when it is placed over the tubing of an existing stand and attached securely to said tubing, the material wraps around the tubing such that two sides of the material project outwards from the stand thus forming two support arms slotted at the ends to receive a platform, the platform itself slotted to engage in return with the support arms, together forming a more rigid structure to which the performers harmonica is affixed to the said platform, the platform shaped to also act as a sound baffle, said sound baffle directing and isolating harmonica and vocal sounds.

6. Apparatus according to claim 5 including: support arm or arms of the holder created from material shaped and bent such that when placed over the tubing of an existing stand the material wraps around the tubing such that the material projects outwards from the stand thus forming the support arm or arms to hold a harmonica.

7. Apparatus according to claim 5 including: a platform slotted to fit in union with the slots provided by the support arms of claim 5, the platform providing a surface to which the harmonica s mounted.

8. A sound baffle providing a surface to which a harmonica is mounted, wherein the sound baffle has two opposing surfaces, each said surface providing both a sound directing and sound blocking region, said regions directing and isolating harmonica and vocal sounds to only preferred sound receiving units, said sound baffle providing a sound blocking barrier interposing multiple sound receiving units.

9. A sound baffle according to claim 8, wherein the sound baffle is flippable to hold a harmonica above or below said sound baffle.

* * * * *